US006422843B1

(12) United States Patent
Sun et al.

(10) Patent No.: US 6,422,843 B1
(45) Date of Patent: Jul. 23, 2002

(54) OIL SUPPLY CROSS-HOLE IN ORBITING SCROLL MEMBER

(75) Inventors: Zili Sun; Robert Carl Witham, both of Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/782,123

(22) Filed: Feb. 13, 2001

(51) Int. Cl.[7] ..... F04C 18/00

(52) U.S. Cl. ..... 418/55.4; 418/55.5; 418/55.6; 418/57; 418/94; 418/99; 184/6.18

(58) Field of Search ..... 418/94, 55.5, 57, 418/55.6, 55.4; 184/6.18

(56) References Cited

U.S. PATENT DOCUMENTS

| | | | | |
|---|---|---|---|---|
| 5,178,527 A | * | 1/1993 | Jung | 418/94 |
| 5,989,000 A | * | 11/1999 | Tomayko et al. | 418/55.5 |
| 6,149,413 A | | 11/2000 | Lifson | |

FOREIGN PATENT DOCUMENTS

| | | | | |
|---|---|---|---|---|
| JP | 55-160192 | * | 12/1980 | 418/55.6 |
| JP | 61-192881 | * | 8/1986 | 418/55.6 |
| JP | 62-113880 | * | 5/1987 | 418/99 |
| JP | 01-277694 | * | 11/1989 | 418/55.6 |
| JP | 04-203380 | * | 7/1992 | 418/55.6 |

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor includes an oil supply cross-hole extending radially outwardly to the outer peripheral surface of the base of the orbiting scroll. The cross-hole supplies lubricant against the crankcase towers such that lubricant is supplied to both the Oldham coupling and the seals for the back pressure chamber. The cross-hole is preferably positioned to be between 80° and 90° downstream from the beginning of the orbiting scroll wrap. In this position, adequate oil will be supplied to lubricate the Oldham coupling and the seal, while at the same time, it is unlikely that an undue amount of lubricant will be allowed into the scroll compressor chambers.

7 Claims, 2 Drawing Sheets

OIL SUPPLY CROSS-HOLE IN ORBITING SCROLL MEMBER

BACKGROUND OF THE INVENTION

This invention relates to a unique position for an oil supply cross-hole in the orbiting scroll of a scroll compressor.

Scroll compressors are becoming widely utilized in refrigerant applications. In a scroll compressor first and second scroll members each have a base and a generally spiral wrap extending from a base. The wraps interfit to define compression chambers. One of the scroll members is caused to orbit relative to the other, and as the scroll member orbits the compression chambers decrease in volume to compress an entrapped refrigerant.

One challenge with scroll compressors involves holding the two scroll members together as the refrigerant begins to be compressed. The opposed wraps must contact the base of the opposed scroll member to define the compression chambers. However, the entrapped refrigerant creates a separating force tending to bias the two scroll members away from each other. Thus, it is typical in scroll compressors to tap a portion of the refrigerant to a back pressure chamber. The back pressure chambers are typically defined by seals within a crankcase which supports the orbiting scroll. Further, outwardly of the seals an Oldham coupling constrains the orbiting scroll to orbiting movement, even though it receives a rotary input from a rotary motor.

One challenge in the prior art is supplying adequate lubricant to the interface between the orbiting scroll and the crankcase to provide sufficient lubrication to both the coupling and the seals.

The crankcase is secured to the non-orbiting scroll through a plurality of structures called crankcase towers. In the prior art, a cross-hole extends through the base of the orbiting scroll to supply lubricant to the outer periphery of the orbiting scroll at a circumferential location generally aligned with one of the crankcase coupling.

In the prior art, the cross-hole was formed at a location slightly upstream of the suction inlet into the scroll compressor. With such a location, there is the potential of lubricant being entrained into the refrigerant being compressed. This is undesirable.

SUMMARY OF THE INVENTION

In the disclosed embodiment of this invention, a cross-hole extends from the inner periphery of the bore of the orbiting scroll radially outwardly to the outer peripheral surface of the orbiting scroll to supply lubricant against a crankcase tower. Preferably this cross-hole is circumferentially downstream from the beginning of the orbiting scroll wrap, and less than 180° downstream from the beginning of the orbiting scroll wrap. More preferably, the cross-hole is between 30° and 90° downstream of the beginning of the scroll wrap. In an illustrated embodiment the cross-hole is a few degrees above 80 downstream of the beginning of the scroll wrap.

In this location, the cross-hole is directed at a crankcase tower, which is desirable for providing adequate lubrication. Further, the position is far enough downstream that lubricant will not likely be drawn into the compression chambers in any undue quantities.

These and other features of the present invention can be best understood from the following specification and drawings, the following of which is a brief description.

DETAILED DESCRIPTION OF A PREFERRED EMBODIMENT

Figure 1:
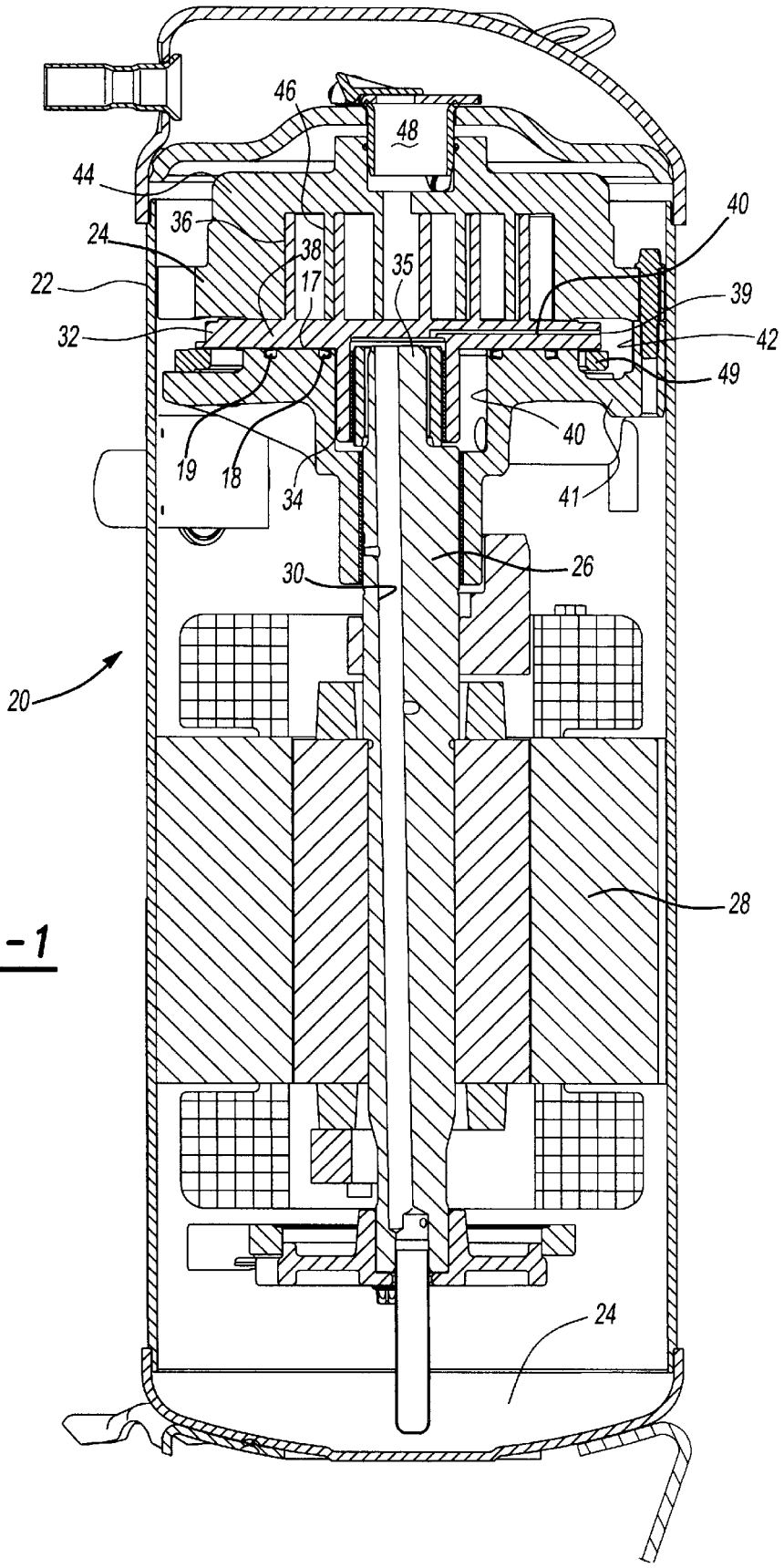
FIG. 1 is a cross-sectional view of a scroll compressor according to this invention.

A scroll compressor 20 is illustrated in FIG. 1 having a housing shell 22 enclosing a quantity of oil 24. A shaft 26 is driven to rotate by an electric motor 28 within the housing 22. Lubricant is drawn from sump 24 upwardly through a lubricant supply passage 30. An orbiting scroll member 32 has a downwardly extending boss 34 surrounding eccentric pin 35 from the shaft. Lubricant is supplied through the port 30 upwardly into the area of the boss 34. This lubricant extends through the base 38 of the orbiting scroll 32 and through a cross-hole 40 to a crosshole outlet 39 positioned circumferentially aligned with a crankcase tower 42. As shown, the orbiting scroll 32 has a generally spiral wrap 36. The orbiting scroll faces and is meshed with a non-orbiting scroll 44 having its own wrap 46. The two wraps of the two scroll members 36 and 44 compress the entrapped refrigerant and deliver it to a discharge opening 48. An Oldham coupling 49 constrains the orbiting scroll 32 for orbital movement relative to the non-orbiting scroll 44. As shown, a back pressure tap 17 taps a refrigerant to a back pressure chamber defined between seals 18 and 19.

As is known, the purpose of the cross-hole 42 is to deliver lubricant against the inner periphery of the crankcase tower 40 such that there will be sufficient lubricant for the seal 19 and the coupling 49.

Figure 2:
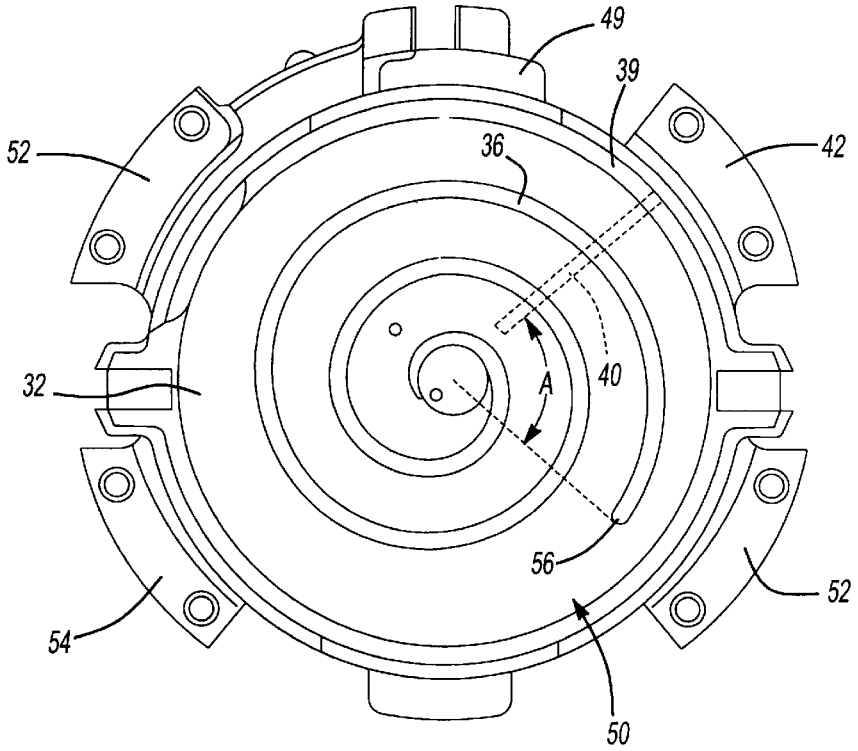
FIG. 2 is a plan view of an orbiting scroll assembly incorporating the present invention.

As shown in FIG. 2, most preferably, the cross-hole 40 is positioned by an angle A from a beginning point 56 of the orbiting scroll wrap 36. As shown the outlet 39 faces a crankcase tower 42. Further, as shown, the suction inlet 50 into the scroll compressor is at a position slightly upstream of the beginning point 56 of the scroll wrap. The direction of orbital movement of the scroll wrap is counter-clockwise in the view shown in FIG. 2. Other crankcase towers 52 and 54 are shown circumferentially spaced around the orbiting scroll member 32.

The angle A is preferably chosen to be greater than 0 but less than 180°. In this way, the outlet 39 is positioned such that it is unlikely lubricant will be mixed into the suction flow 50. Further, the outlet 39 is preferably circumferentially aligned with a crankcase tower 42. With orbital movement of the orbiting scroll, the relative location of the outlet 39 and the tower will change, however, throughout the orbital movement, it is likely that the outlet 39 will preferably be aligned with a portion of the crankcase tower 42. In this way, the tower 42 can provide a deflection surface for deflecting the oil back inwardly toward the seal and coupling. More preferably, it is preferred that the angle A be between 30° and 90°. The preferred angle is slightly over 80° as is illustrated in FIG. 2.

Figure 3:
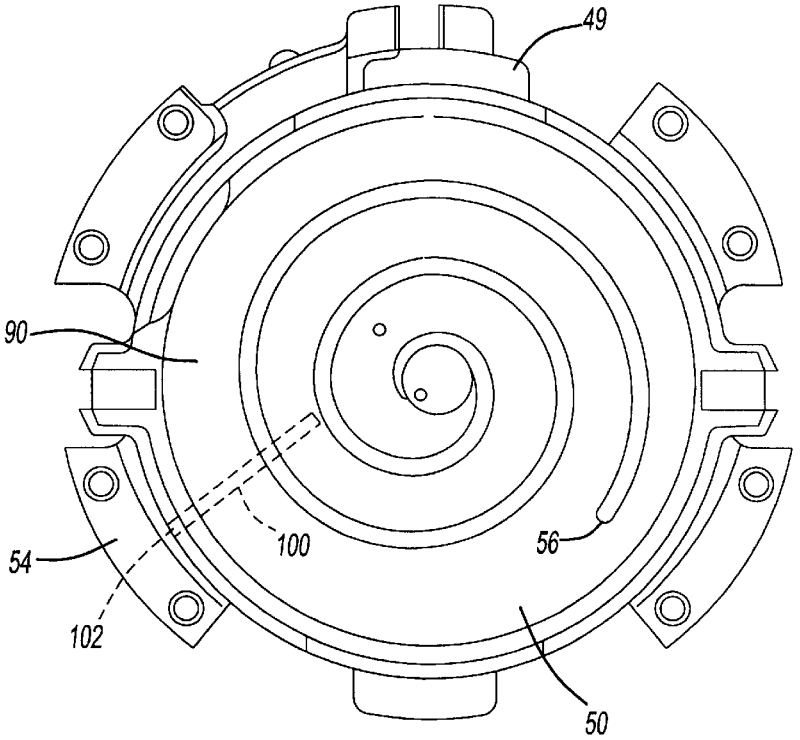
Fig-3 PRIOR ART
FIG. 3 shows the prior art.

FIG. 3 shows the prior art wherein a cross-hole 50 was positioned further upstream from the position illustrated in FIG. 2. The outlet 102 was aligned with the crankcase tower 54. In this position there was the possibility of lubricant mixing into the suction flow 50, which is undesirable.

Although a preferred embodiment of this invention has been disclosed, a worker in this art would recognize that modifications would come within the scope of this invention. For that reason the following claims should be studied to determine the true scope and content of this invention.

We claim:

1. A scroll compressor comprising:

a first scroll member having a base and a generally spiral wrap extending from said base;

a second scroll member having a base and a generally spiral wrap extending from its base;

a crankcase for supporting said second scroll member, said second scroll member being driven to orbit relative to said first scroll member;

a driveshaft being driven by a motor for causing said second scroll member to orbit, and a coupling positioned to constrain said second scroll member to orbit; and an oil supply port passing through said drive shaft, and an oil cross-hole extending through said base of said second scroll member to an outer peripheral surface of said second scroll member, said oil support cross-hole being at a location between 0 and 180° measured from a beginning point of said wrap of said second scroll member measured in a downstream direction.

2. A scroll compressor as recited in claim 1, wherein said crankcase includes a number of crankcase towers extending upwardly and along an outer peripheral surface of said second scroll member, and said cross-hole being circumferentially aligned with one of said crankcase towers.

3. A scroll compressor as recited in claim 1, wherein said cross-hole is positioned from said beginning point of said scroll wrap by an angle between 30° and 90° in a downstream direction.

4. A scroll compressor as recited in claim 3, wherein said angle is between 80° and 90°.

5. A scroll compressor as recited in claim 1, wherein a pair of spaced seals are positioned in said crankcase for defining a back pressure chamber, said oil supply ports supplying oil to said seals.

6. A scroll compressor as recited in claim 5, wherein said oil supply port further supplying oil to said coupling.

7. A scroll compressor comprising:

a first scroll member having a base and a generally spiral wrap extending from said base;

a second scroll member having a base and a generally spiral wrap extending from its base;

a crankcase for supporting said second scroll member, said second scroll member being driven to orbit relative to said first scroll member, said crankcase including a number of crankcase towers extending upwardly and along an outer peripheral surface of said second scroll member;

a drive shaft being driven by a motor for causing said scroll member to orbit, and a coupling positioned to constrain said second scroll member to orbit; and an oil supply port passing through said drive shaft, and a oil cross-hole extending through said base of said second scroll member to an outer peripheral surface of said second scroll member, said oil support cross-hole being at a location between 30° and 90° measured from a beginning point of said wrap of said second scroll member measured in a downstream direction, said cross-hole also being circumferentially aligned with one of said crankcase towers.

* * * * *